US007506581B2

(12) United States Patent
Yoshida

(10) Patent No.: US 7,506,581 B2
(45) Date of Patent: Mar. 24, 2009

(54) PRESS MACHINE

(75) Inventor: Akihiro Yoshida, Gifu (JP)

(73) Assignee: Kabushiki Kaisha Yamada Dobby, Ichinomiya-Shi, Aichi-Ken (JP)

( * ) Notice: Subject to any disclaimer, the term of this patent is extended or adjusted under 35 U.S.C. 154(b) by 0 days.

(21) Appl. No.: 11/961,891

(22) Filed: Dec. 20, 2007

(65) Prior Publication Data

US 2008/0156206 A1 Jul. 3, 2008

(30) Foreign Application Priority Data

Dec. 27, 2006 (JP) ..... 2006-353163

(51) Int. Cl.
*B30B 1/06* (2006.01)

(52) U.S. Cl. ..... 100/283; 100/257; 100/282; 100/286; 100/287; 72/451

(58) Field of Classification Search ..... 100/257, 100/281, 282, 283, 284, 285, 286, 287; 72/450, 72/451; 83/626
See application file for complete search history.

(56) References Cited

U.S. PATENT DOCUMENTS 4,156,387 A * 5/1979 Portmann ..... 100/257
5,287,728 A * 2/1994 Yoshida ..... 74/40
5,746,123 A * 5/1998 Eigenmann ..... 100/208
6,055,903 A * 5/2000 Eigenmann ..... 100/257
2002/0020307 A1 * 2/2002 Imanishi ..... 100/257

FOREIGN PATENT DOCUMENTS

| | | |
|---|---|---|
| JP | 08-118082 | 5/1996 |
| JP | 2000-202691 | 7/2000 |
| JP | 2002-035993 | 2/2002 |

* cited by examiner

*Primary Examiner*—Jimmy T Nguyen
(74) *Attorney, Agent, or Firm*—Stoel Rives LLP

(57) ABSTRACT

A press machine is configured with an adjustable slide stroke length. The press machine comprises a frame, a crankshaft borne rotatably on the frame, a slide disposed under the crankshaft, a first lever swingably supported on the frame, a second lever swingably connected to the first lever through a first pin, a displacing mechanism for displacing the first pin, and a linear approximation mechanism that exerts a horizontal force to the first pin so as to convert a rotation of each eccentric portion of the crankshaft into an elevating motion of the slide.

12 Claims, 18 Drawing Sheets

PRESS MACHINE

RELATED APPLICATION

This application claims priority under 35 U.S.C. § 119 to Japanese Patent Application No. 2006-353163 filed Dec. 27, 2006, the entire contents of which are incorporated herein by reference.

TECHNICAL FIELD

The present disclosure relates to a press machine and, more particularly, to a press machine having a linkage for converting rotation of a crankshaft into vertical motion of a slide, in which a stroke length of a slide can be adjusted.

BACKGROUND INFORMATION

A conventional press machine, specifically, a mechanical press, has been disclosed that includes a connection swingably connected to each of two eccentric portions of a crank shaft borne rotatably on a frame, and a lever connected to a slide, in which the connection and the lever are movably connected to the crankshaft. See Japanese Patent Appln. Public Disclosure No. 8-118082; Japanese Patent Appln. Public Disclosure No. 2000-202691; and Japanese Patent Appln. Public Disclosure No. 2002-35993.

According to the above documents, a load providing a vertical force is converted into equal loads providing horizontal forces in directions opposite from each other relative to a crankshaft, by symmetric linkages to eccentric portions of the crankshaft. This configuration results in the horizontal loads of the crankshaft being mutually cancelled to maintain a balance in the loads, thereby enabling efficient transmission of power from a power source to facilitate rotation of the crankshaft. Thus, constant balance between the horizontal loads is an advantageous feature for a press machine with a crankshaft having two symmetric eccentric portions.

In the foregoing conventional press machine, however, the stroke length of the slide was always constant and was not adjustable. Depending on an object to be pressed, however, a press machine may require change in a top dead center and a bottom dead center to adjust the stroke length.

SUMMARY OF THE DISCLOSURE

A press machine includes a link mechanism in which horizontal loads to a crankshaft are mutually cancelled to maintain the load balance and which is capable of adjusting a slide stroke length. The press machine of the present disclosure includes, in one embodiment, a frame, a crankshaft with two eccentric portions rotatably borne on the frame, an elevatable slide disposed under the crankshaft, and two sets of levers on both sides of the crankshaft supporting the slide. Additionally, each set of the levers includes a first lever borne on the frame swingably about an axis parallel to the axis of the crankshaft, and a second lever connected to the first lever through a first pin parallel to the crankshaft. The press machine also includes a displacing mechanism attached to the frame to displace the first pin, and a linear approximation mechanism for exerting a horizontal force on each first pin so as to convert the rotation of each eccentric portion of the crankshaft into the elevating motion of the slide. The linear approximation mechanism includes: the first lever, a connection swingably connected to each eccentric portion of the crankshaft, a third lever connected to the connection through the second pin parallel to the crankshaft, and a fourth lever connected to the third lever through a third pin parallel to the crankshaft, in which the first pin penetrates the fourth lever.

The frame, in at least one embodiment, is provided with a first groove slidably supporting the second pin extending horizontally relative to the crankshaft.

The displacing mechanism, in at least one embodiment, includes: the fourth lever, a fifth lever connected to the third pin, and an adjusting screw connected to the fifth lever through the fourth pin, in which the adjusting screw is attached to the frame so as to freely advance or retreat relative to the frame.

Also, in at least one embodiment, the linear approximation mechanism shares with the displacing mechanism the fourth pin and the adjusting screw.

The displacing mechanism, in another embodiment includes: the fourth lever, a fifth lever connected to the third pin, and an adjusting screw connected to the fifth lever through the fourth pin, in which the adjusting screw is attached to the frame so as to move freely along the frame.

Also, the linear approximation mechanism, in another embodiment, shares with the displacing mechanism the adjusting screw.

The displacing mechanism, in another embodiment, includes: the fourth lever, a rotating member rotatably attached to the frame, and a mechanism for adjusting the rotation angle of the rotating member. The rotating member is provided with a second groove for supporting the third pin so as to slide.

According to the present disclosure, the first lever, the connection swingably connected to each eccentric portion of the crankshaft, the third lever connected to the connection relative to the crankshaft through the second pin, and the fourth lever connected to the third lever through the third pin parallel to the crankshaft are provided relative to each first pin. The first pin penetrates the fourth lever of the linear approximation mechanism, thereby realizing a symmetrical linkage. Thus, horizontal loads from right and left relative to the crankshaft are mutually cancelled to maintain load balance.

Because the displacing mechanism displaces the first pin, the first pin forming a nodal point of the second lever that supports the slide, the slide can be displaced through the second lever. Thereby, the stroke length can be adjusted by changing the top and bottom dead centers of the slide.

Since the frame has the first groove slidably supporting the second pin, the second pin can move linearly along the first groove when the press machine is operating. Also, the second pin, being connected to the first pin through the third lever and the fourth lever, does not directly receive a vertical load due to a load applied to the first pin, so that generation of frictional heat generated between the first groove and the second pin to cause inhibition in accelerating the press machine can be reduced.

The displacing mechanism includes: the fourth lever, the fifth lever connected to the third pin, and an adjusting screw connected to the fifth lever through the fourth pin. Moreover, the adjusting screw is attached to the frame so as to move forward and backward freely. Therefore, the third pin is displaced according to the amount of movement of the adjusting screw to the frame to enable to displace the first pin through the fourth lever. The top and bottom dead centers of the slide can be changed, thereby enabling adjustment of the stroke length.

Since the amount of displacement of the third pin is different, when different adjustments are carried out to the respective adjusting screws, each first pin and its second lever can be displaced by a different amount to give an inclination to the slide. Thus, by giving such inclination to a slide under an eccentric load, it is possible to compensate the eccentric load.

Further, since the position of the second pin is regulated by the first groove, the third pin can be displaced approximately in a horizontal line relative to the crankshaft. Thus, the third pin can be placed at a position that is easily displaced by the displacing mechanism.

The respective linear approximation mechanism can share the fourth pins and the adjusting screw. Thereby, it is not necessary to adjust the displacing amount of the third pin uniformly in each linear approximation mechanism, so that it is possible to realize a simple adjustment of displacement.

The displacing mechanism includes the fifth lever connected to the third pin, and the adjusting screw connected to the fifth lever through the fourth pin. Since the adjusting screw and the fourth pin are attached to the frame movably along the frame, the third pin can be displaced according to the amount of movement along the frame. As a result, the first pin can be displaced through the fourth lever. Thus, the top and bottom dead centers of the slide can be changed, thereby enabling to adjust the stroke length.

Since an amount of displacement of the third pin varies when different adjustment is made to each adjusting screw, each of the first pin and its second lever can be displaced by a different amount, and an inclination can be given to the slide. Thus, relative to the slide with an eccentric load, the eccentric load can be corrected by the inclination.

The respective linear approximation mechanisms can share the adjusting screw. Thus, it is not necessary to adjust the amount of displacement of the third pin uniformly in each linear approximation mechanism, thereby enabling simple adjustment of displacement.

The displacing mechanism includes the fourth lever, a rotating member rotatably attached to the frame, and a mechanism for adjusting the rotation angle of the rotating member. The rotating member is provided with a second groove that supports the third pin slidably. Hence, by adjusting the rotating angle of the rotating member, the third pin can be displaced along the second groove, so that the first pin can be displaced through the fourth lever. Thus, it is possible to change the top and bottom dead centers of the slide and adjust the stroke length.

If the rotating angles of respective rotating members are adjusted to be different, an amount of displacement of the third pin regulated by the second groove varies, so that each of the first pin and its second lever can be displaced by a different amount to give an inclination to the slide. Thus, relative to the slide with an eccentric load, the eccentric load can be corrected by giving the inclination.

Also, since the position of the bottom dead center differs with the rotating angle of the rotating member, a delicate bottom dead center position can be corrected by adjusting a delicate amount of movement.

DETAILED DESCRIPTION OF PREFERRED EMBODIMENTS

Hereinafter, the best mode to carry out the present invention is described as Embodiment 1 through Embodiment 6.

Embodiment 1

Figure 1:
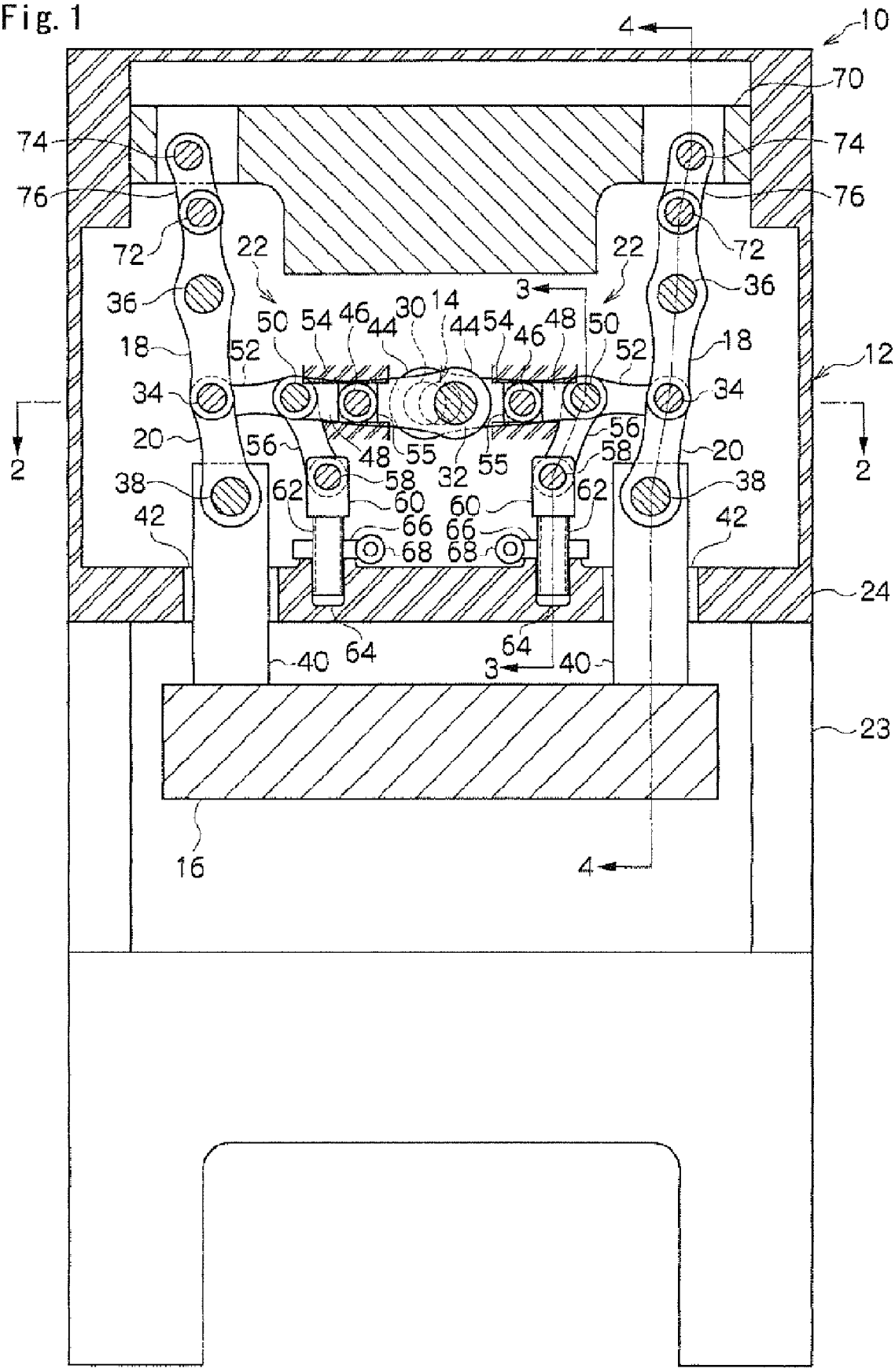
FIG. 1 is a vertical section of the press machine according to a first embodiment.
Figure 2:
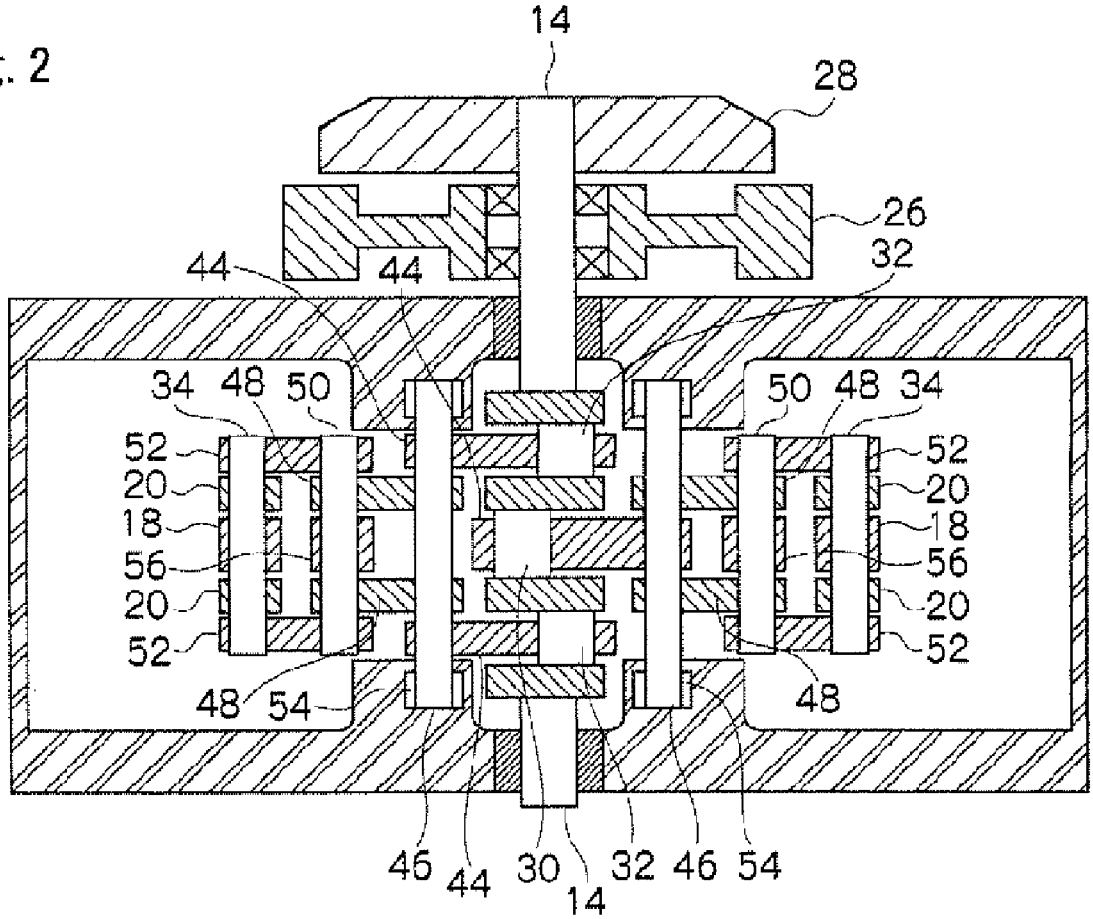
FIG. 2 is a cross section obtained along the line 2-2 in FIG. 1.
Figure 3:
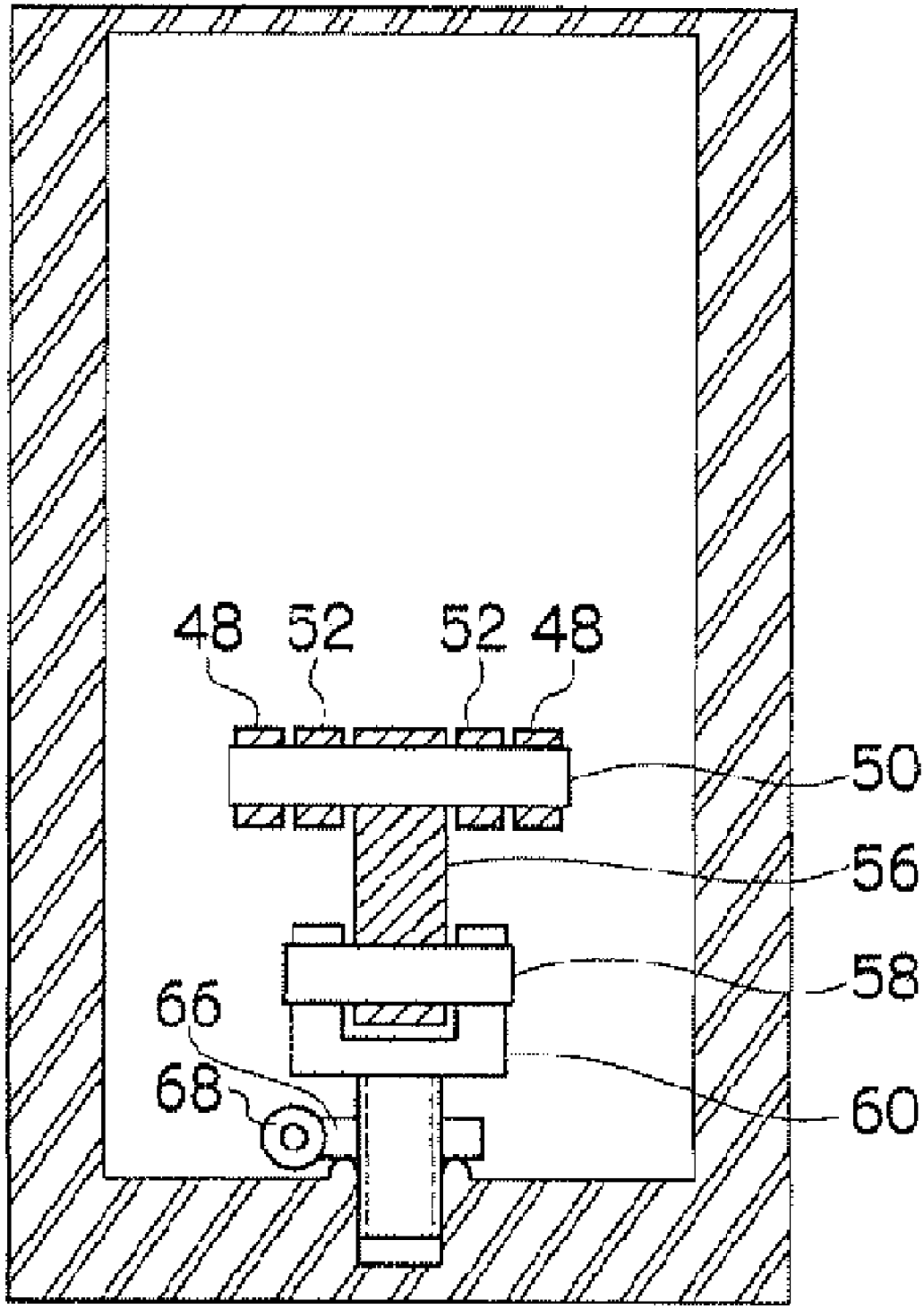
FIG. 3 is a vertical section obtained along the line 3-3 in FIG. 1.
Figure 4:
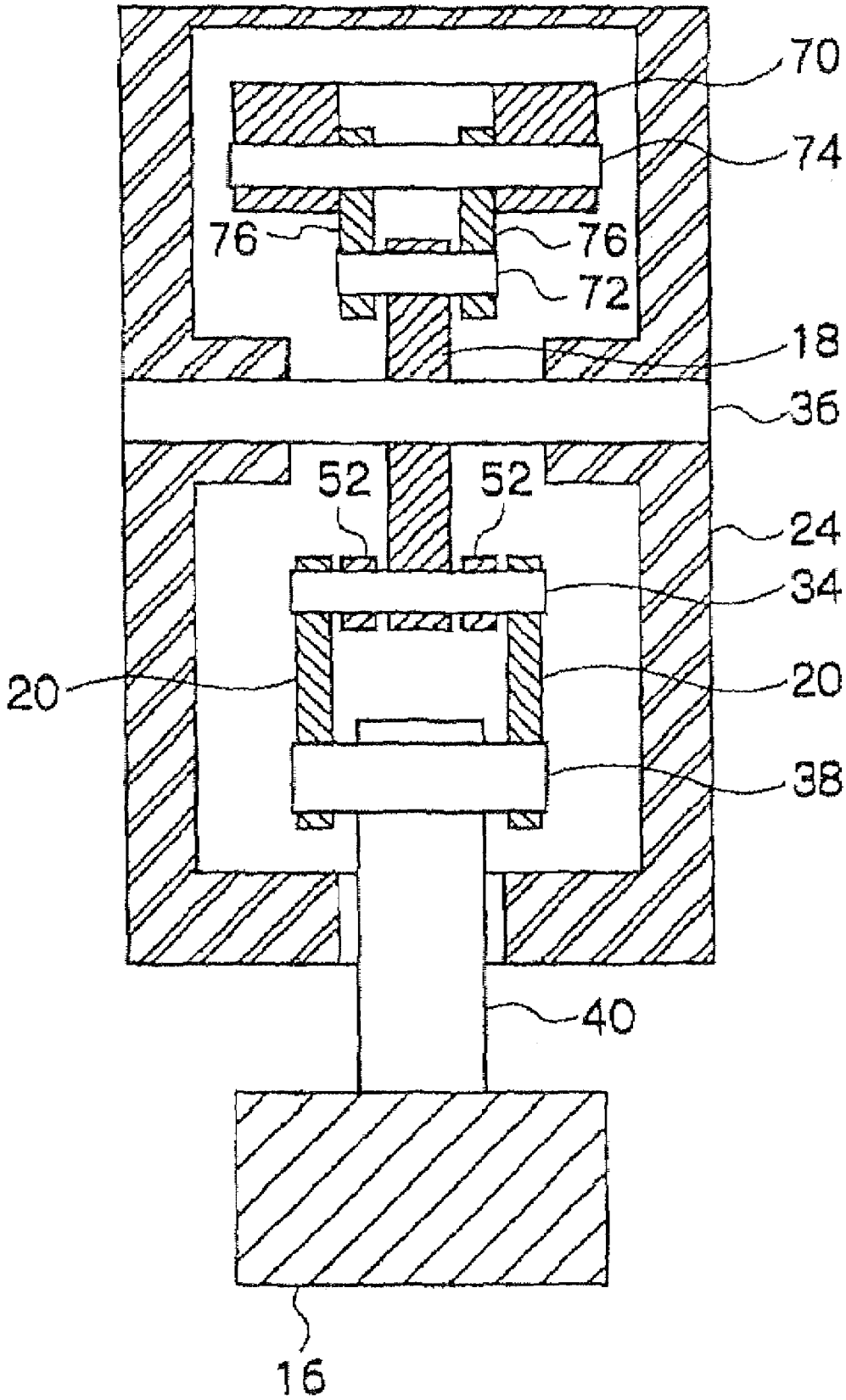
FIG. 4 is a vertical section obtained along the line 4-4 in FIG. 1.

FIG. 1 is a vertical section of the press machine according to the first embodiment showing a state where the slide is at the bottom dead center. FIG. 2 is a cross section obtained along the line 2-2 in FIG. 1; FIG. 3 is a vertical section obtained along line 3-3 in FIG. 1; and FIG. 4 is a vertical section obtained along the line 4-4 in FIG. 1.

Referring to FIG. 1, a ring-press type press machine according to the first embodiment is generally shown by reference numeral 10.

The press machine 10 comprises: a frame 12; a crankshaft 14; an elevatable slide 16 disposed under the crankshaft; two sets of levers 18, 20 located on both sides of crankshaft 14 and supporting elevatable slide 16; and two linear approximation mechanisms 22.

Frame 12 as shown includes a lower frame 23 and an upper frame 24. On lower frame 23, a drag of a press die (not shown) having a drag and a cope is mounted. Inside lower frame 23, a slide 16 with the cope of the press die attached is disposed so as to move up and down. Slide 16 is located below crankshaft 14.

Crankshaft 14 is disposed within upper frame 24 and rotatably borne on upper frame 24 to extend horizontally in the direction of the back of the sheet as viewed in FIG. 1. Crankshaft 14 is supplied with rotating power by a drive source (not shown) such as a motor to be connected to crankshaft 14.

As shown in FIG. 2, a flywheel 26 is fitted on crankshaft 14 outside frame 12 at its end portion, and a clutch 28 is attached to an end portion of crankshaft 14. The clutch 28 has an action substantially to secure or release flywheel 26, which is connected to the drive source at the end portion of crankshaft 14.

Crankshaft 14 has one eccentric portion 30 and two other eccentric portions 32 (see FIG. 2). Eccentric portion 30 is positioned at a nearly central portion of crankshaft 14 relative to the longitudinal direction, and eccentric portions 32 are positioned on both sides of eccentric portion 30 of crankshaft 14 relative to the longitudinal direction.

Eccentric portion 30 and eccentric portions 32 are equal in the amount of eccentricity. In other words, distances between the axis of each eccentric portion in crankshaft 14 and the axes of other parts excluding these eccentric portions are the same. Further, eccentric portion 30 and eccentric portions 32 are biased on opposite sides to each other. Incidentally, it is possible to provide one eccentric portion 32 instead of two as shown.

One lever (a first lever) 18 of each set of levers that support slide 16 at upper frame 24 and two levers (second levers) 20 sandwiching first lever 18 are connected swingably to each other through a pin (first pin) 34 parallel to crankshaft 14. These levers 18, 20 extend vertically like a straight line as viewed in FIG. 1 where slide 16 is at the lowermost position (bottom dead center). Incidentally, it is possible to provide one second lever 20 instead of two as illustrated.

Among these levers, first lever 18 located above is swingably borne at its other end portion (upper end portion) on upper frame 24 through a shaft 36 parallel to crankshaft 14. On the other hand, the other end portions (lower end portion) of second levers 20 located below are connected to plungers 40 secured to slide 16 through a pin 38. Plungers 40 are provided on the bottom plate of upper frame 24 and extend upward and downward through cylindrical metal bearings 42 that penetrate the bottom plate.

As shown, when a horizontal force is applied to first pin 34 forming a nodal point of first lever 18 and second lever 20 to move in the horizontal direction (rightward), first and second levers 18, 20 respectively swing about pin 34, shaft 36, and pin 38. As a result, as viewed in FIGS. 1 and 5, the angle between first and second levers 18 and 20 changes to an angle of about 180° or less, and slide 16 moves upward.

Application of the horizontal force to first pin 34 and its horizontal movement are performed through a linear approximation mechanism 22. In other words, linear approximation mechanism 22 can move first pin 34 nearly linearly in the horizontal direction within a predetermined range accompanying the rotation of the crankshaft 14 under restraint by first lever 18.

Two linear approximation mechanisms 22 forming the linkage include, in the illustration, one connection and two connections 44, respectively connected swingably to the three eccentric portions 30, 32 of crankshaft 14 and extended horizontally in the opposite direction to each other.

Linear approximation mechanisms 22 further include: two sets (one set includes two) of third levers 48 respectively connected to the one and two connections 44 through two pins (second pins) 46 parallel to crankshaft 14, two sets of two fourth levers 52 and fifth levers 56 connected swingably to third levers 48 through two pins (third pins) 50 parallel to crankshaft 14, and two adjusting screws 60 swingably connected to fifth levers 56 through two pins (fourth pins) 58 parallel to crankshaft 14.

Two sets of two guide grooves 54 extending horizontally parallel to crankshaft 14 are provided on the inner wall face in the front and back of upper frame 24 close to crankshaft 14. Pins 46 are provided with first slide members 55 fitting to both end portions, and slide members 55 slide while maintaining a parallel state with crankshaft 14 within the guide grooves 54, following the action of the eccentric portions 30, 32 of the crankshaft.

First lever 18 forms a part of the linear approximation mechanism 22. Also, each guide groove 54 is provided integrally with the inner wall face of the upper frame 24, but can be provided in a separate member attached to the upper frame 24. Further, since guide groove 54 as shown is extended horizontally to crankshaft 14, pin 46, which slides along guide groove 54, moves linearly. Within the range of guide groove 54, in which pin 46 linearly moves, linear approximation mechanism 22 includes a linear mechanism in part thereof. Incidentally, the illustrated guide groove 54 extends horizontally to crankshaft 14, but it can be given an inclination and moved linearly.

Adjusting screw 60 has a screw portion 62 to be screwed into a hole 64 of the screw portion (not shown) provided on the bottom plate of upper frame 24.

Adjusting screw 60 is provided with a worm screw 68 provided on the bottom plate of upper frame 24 in a state of being in contact with the screw portion 62, and a worm wheel 66 provided at its end portion.

When worm screw 68 is rotated, its rotational force is transmitted to the screw portion 62 of adjusting screw 60 through worm wheel 66, and screw portion 62 moves forward and backward (upward and downward in FIG. 1) relative to hole 64 in its depth direction. Following this movement, as shown in FIGS. 1 and 6 or FIGS. 5 and 7, the force due to forward and backward movement via pin 58, fifth lever 56, pin 50, and fourth lever 52 acts on pin 34 to move it linearly approximately in the horizontal direction relative to crankshaft 14.

Figure 5:
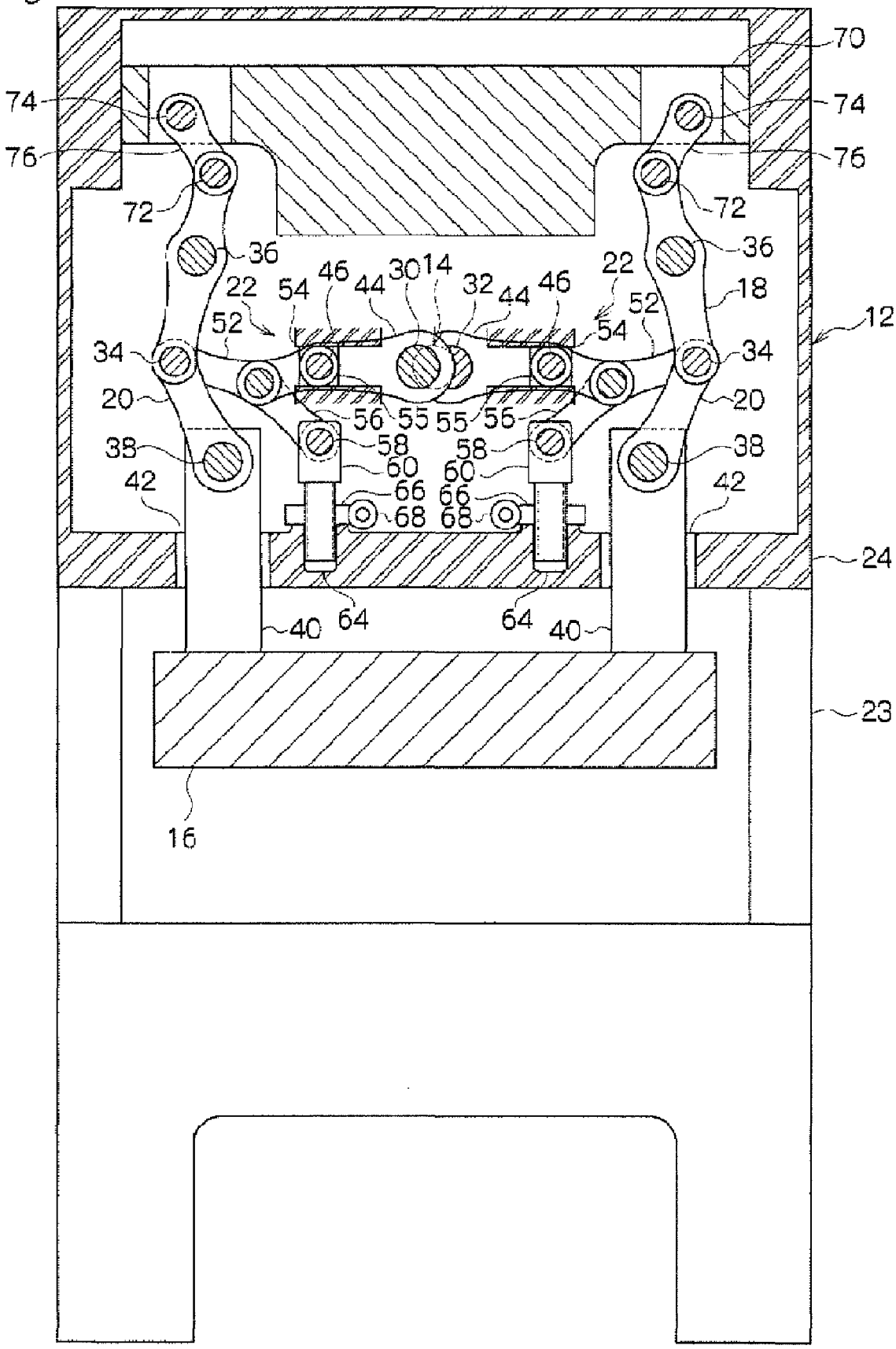
FIG. 5 is a vertical section of the press machine under operating condition of the linear approximation mechanism in FIG. 1.
Figure 6:
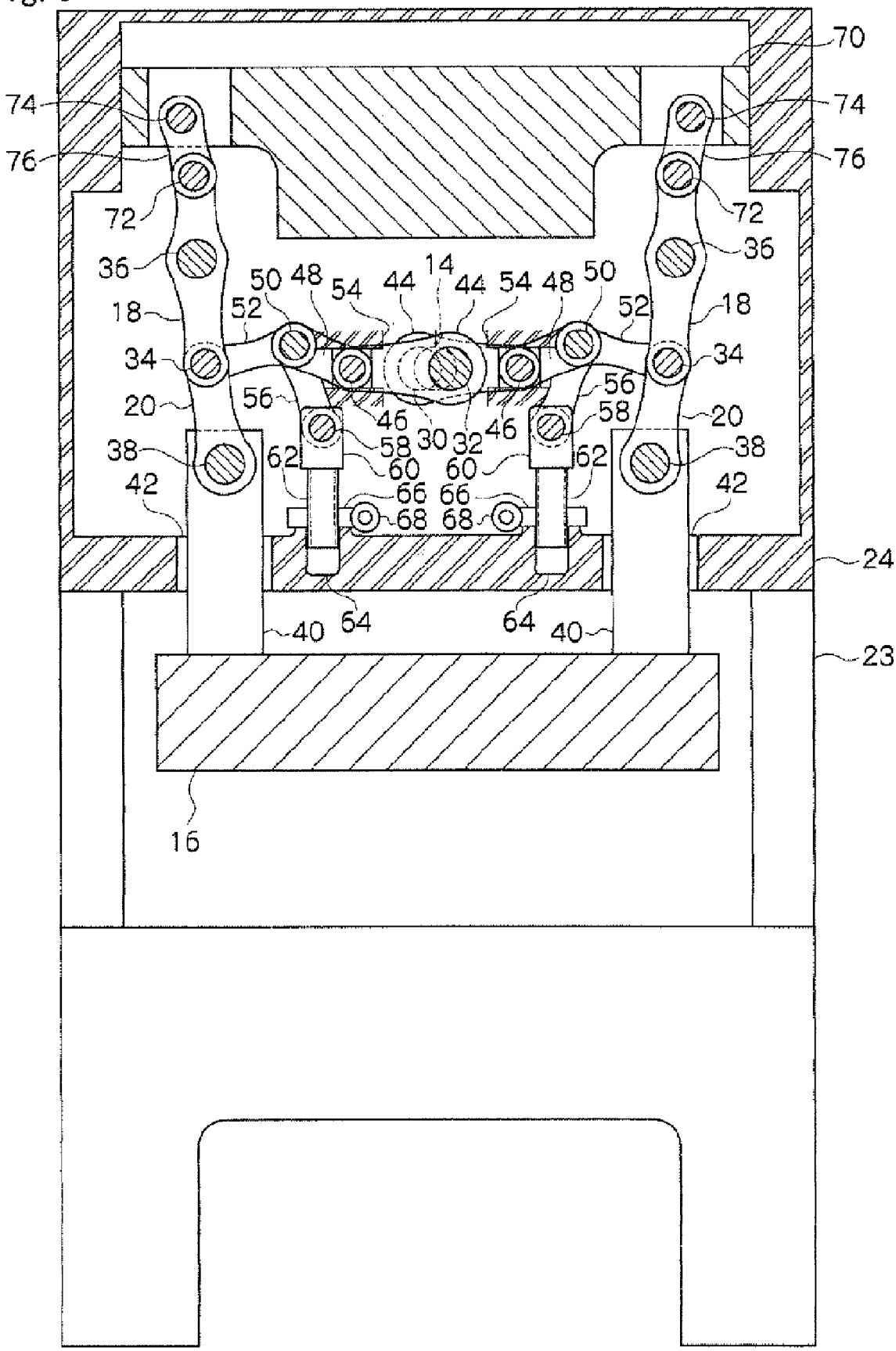
FIG. 6 is a vertical section of the press machine under operating condition of the linear approximation mechanism with the adjusting screw in FIG. 1 retreated.
Figure 7:
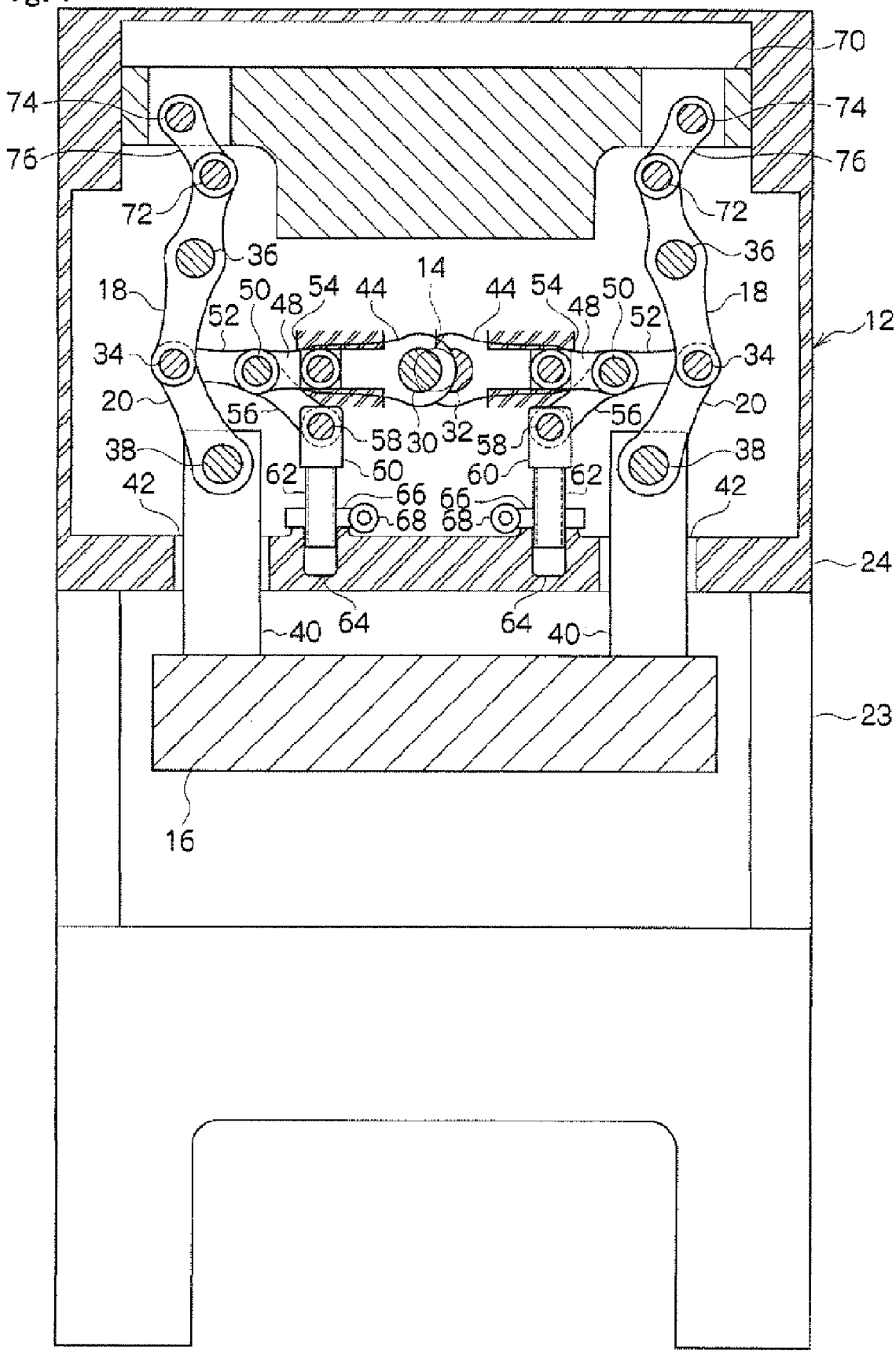
FIG. 7 is a vertical section of the press machine under operating condition of the linear approximation mechanism with the adjusting screw in FIG. 5 retreated.

FIG. 5 shows an operating state of press machine 10 with the adjusting screw 60 screwed into hole 64, in which slide 16 is located at the uppermost position (top dead center). On the other hand, FIGS. 6 and 7 show an operating state of press machine 10 in a state that adjusting screw 60 is retreated from hole 64. In FIG. 6, slide 16 is at the bottom dead center, while in FIG. 7 it is at the top dead center.

As will be understood from a comparison between FIGS. 1 and 6, withdrawal of adjusting screw 60 makes first pin 34 slightly displace toward fourth pin 50. This is so because pin 50 is displaced upward, and accompanying therewith, fourth lever 52 pulls first pin 34. Following the displacement of first pin 34, the linearity of first lever 18 and second lever 20 increases, and the bottom dead center of slide 16 in FIG. 6 descends in comparison with the bottom dead center of slide 16 in FIG. 1, thereby changing a stroke length under an operating condition of press machine 10.

This can be understood likewise from a comparison between FIGS. 5 and 7. In other words, by the withdrawal of adjusting screw 60, first pin 34 is displaced in a direction to be slightly away from crankshaft 14. This is so because fourth lever 50 displaces upward, followed by fourth lever 52 pushing first pin 34 out. Following the displacement of first pin 34, the inclinations of first lever 18 and second lever 20 increase, and the top dead center of slide 16 in FIG. 7 rises in comparison with the top dead center of slide 16 in FIG. 5 so that the stroke length is changed under operating condition of press machine 10.

As a matter of course, according to the amount of movement of adjusting screw 60, the positions of the top and bottom dead centers of slide 16 can be adjusted, and the stroke length of slide 16 can be changed.

Also, by adjusting such that the amounts of movement of the respective adjusting screws 60 differ, the top and bottom dead centers changed by the adjusting screws 60 are different, so that slide 16 is given inclination. Thus, by giving the inclination to slide 16 with an eccentric load, it is possible to correct the eccentric load.

Since the bottom dead center differs according to an amount of movement of adjusting screw 60, a bottom dead center position can be delicately corrected by delicately adjusting screw 60.

The illustrated press machine 10 is provided with a counterbalance 70 for canceling the inertia force generated by elevating motion of slide 16 when press machine 10 is operated at a high speed and for ensuring a swift movement of slide 16.

Counterbalance 70 is disposed at the highest position within upper frame 24 so as to be able to move up and down upon receipt of a guiding action of upper frame 24.

Counterbalance 70 is connected to first lever 18 through pin 72 penetrating the upper end portion of first lever 18, a pin 74 penetrating counterbalance 70, and a pair of links 76 connected to both pins 72 and 74. Both pins 72 and 74 have axes respectively parallel to the axis of crankshaft 14. Thus, counterbalance 70 ascends (FIG. 1) with descent of slide 16, and contrariwise, counterbalance 70 descends (FIG. 5) with ascent of slide 16.

Also, press machine 10 can be used when there is no need for high-speed operation. In this case, arrangement of the pins 72, 74 for connecting the counterbalance to first lever 18, both links 76 or the like can be dispensed with.

Embodiment 2

Figure 8:
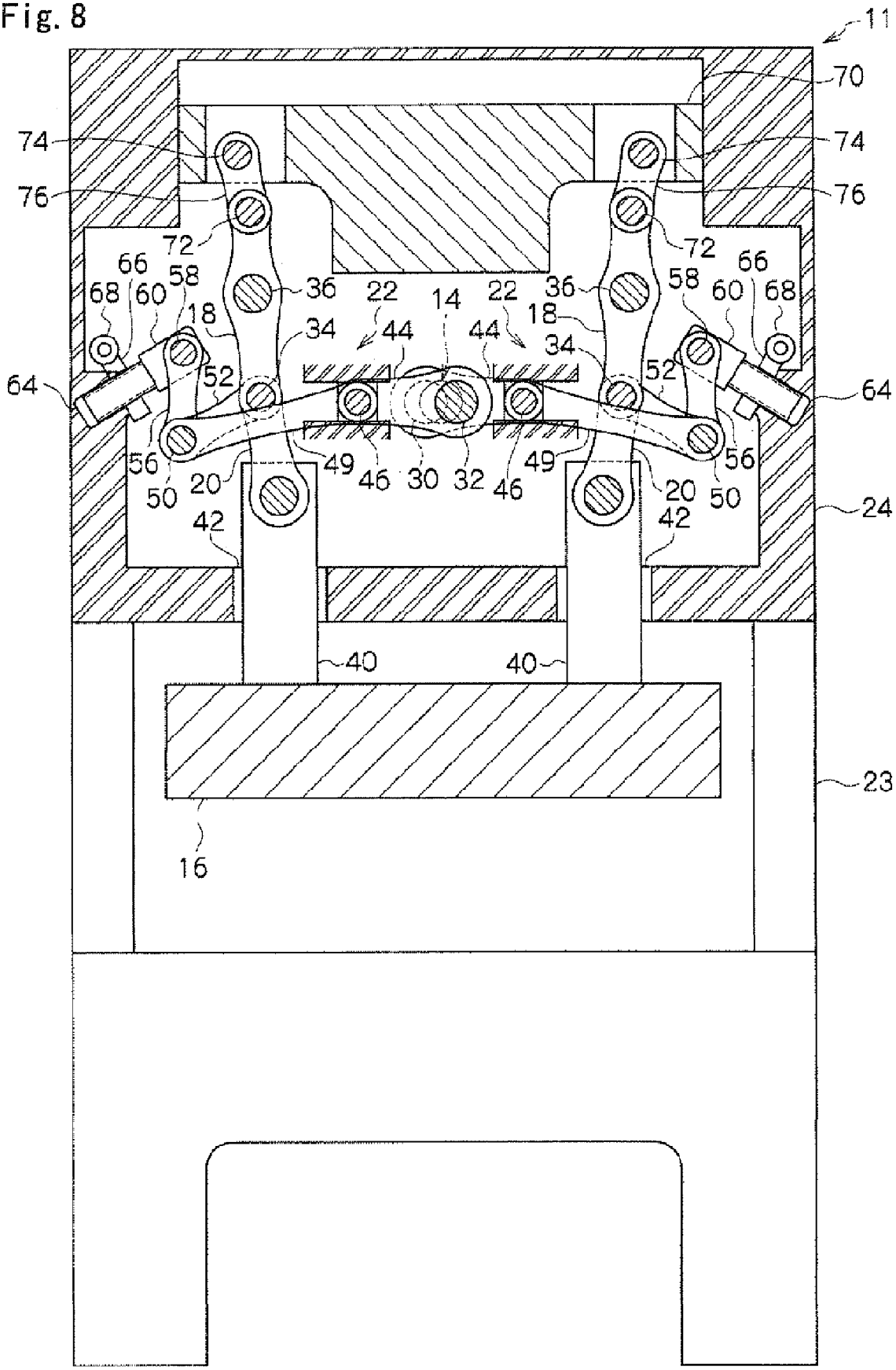
FIG. 8 is a vertical section of the press machine according to a second embodiment.

FIG. 8 is a vertical section of a press machine 11 according to the second embodiment. The same reference numerals are give to the same composing elements of press machine 11 as those of press machine 10 in FIG. 1, and explanations thereon are omitted.

As shown, in press machine 11, adjusting screw 60 is attached to a side plate of upper frame 24 with inclination. According to this attaching position, a lever 49 longer than third lever 48 of press machine 10 is used to apply a horizontal force through third pin 50 and fourth lever 52 and from the side of the side plate of upper frame 24 to first pin 34 to be converted into the elevating motion of slide 16.

Like the press machine 10 in FIG. 1, third pin 50 is displaced according to the amount of movement of adjusting screw 60, but different from the press machine 10, first pin 34 is displaced from the side of the side plate of upper frame 24 through fourth lever 52. Following this displacement, the top dead center of slide 16 changes, and its stroke length is adjusted.

Incidentally, if third pin 50 can be displaced, the press machine 11 can be configured using an arbitrary angle, not limited to the attaching angle of the illustrated adjusting screw 60.

Since, in this embodiment, adjusting screw 60 is not attached between plungers 40, there is no need to have a large pitch for attachment, so that the press machine itself can be downsized.

Embodiment 3

Figure 9:
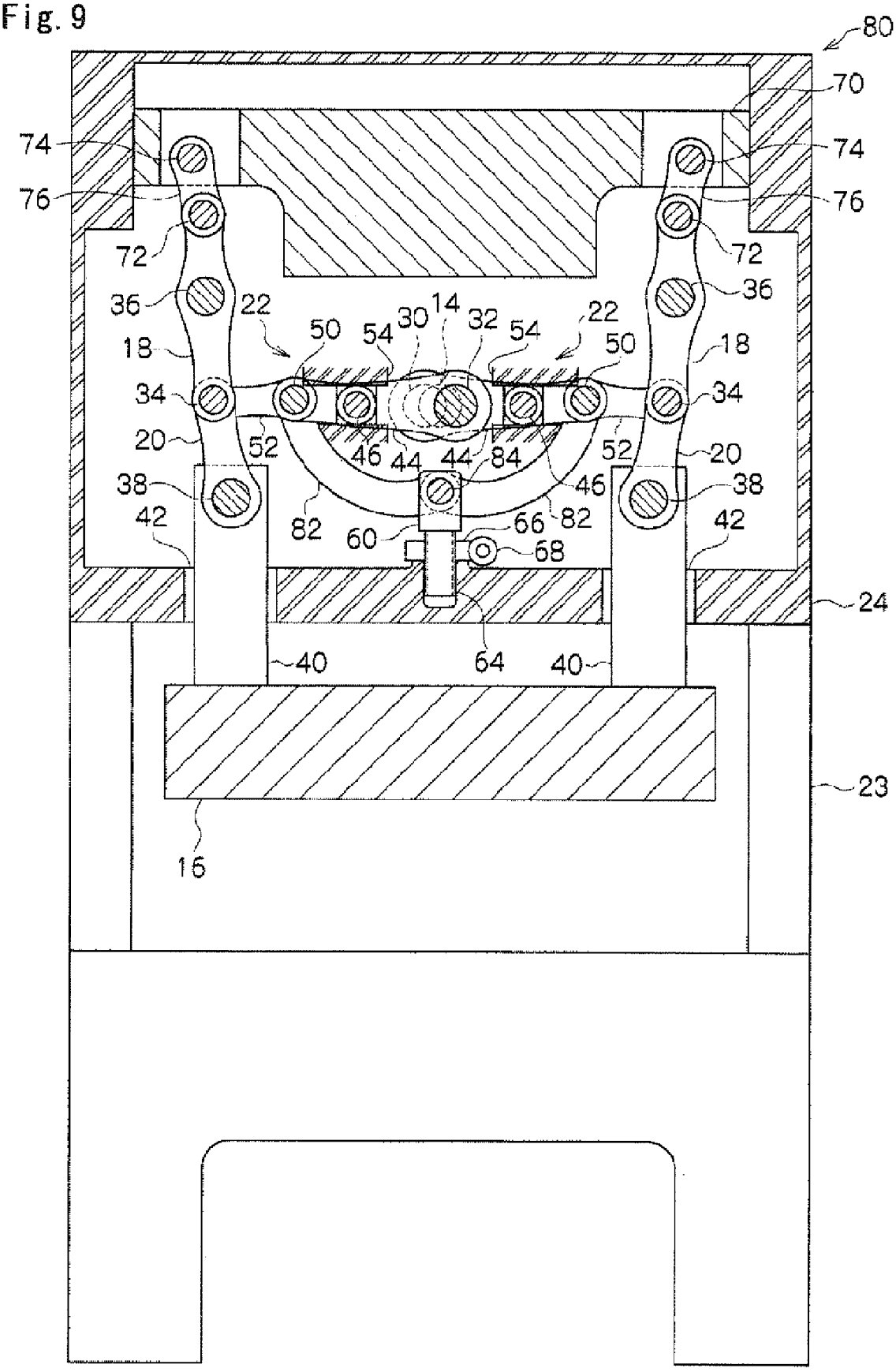
FIG. 9 is a vertical section of the press machine according to a third embodiment.

FIG. 9 is a vertical section of a press machine 80 according to the third embodiment. Regarding the composing elements of this press machine, the same reference numerals are given to the same elements, and explanations thereon are omitted.

As shown, press machine 80 includes, as elements different from those of the press machine 10 in FIG. 1, two fifth levers 82 connected swingably to pins 50 of both linear approximation mechanisms 22, and one adjusting screw 60 to which both fifth levers 82 are swingably connected through one pin 84 (the fourth pin). The mechanism wherein the adjusting screw 60 is operated to displace pin 34 through pin 50 and to adjust the stroke length of slide 16 is the same as in the first embodiment.

In this embodiment, by operating a single adjusting screw, the respective first pins 34 can be displaced simultaneously by the same amount, so that the top and bottom dead centers can be easily adjusted while maintaining slide 16 horizontally. Thus, in comparison with the first embodiment in which the amounts of movement of two adjusting screws should be uniformly adjusted, the stroke length can be accurately adjusted by a simple operation according to this embodiment.

Embodiment 4

Figure 10:
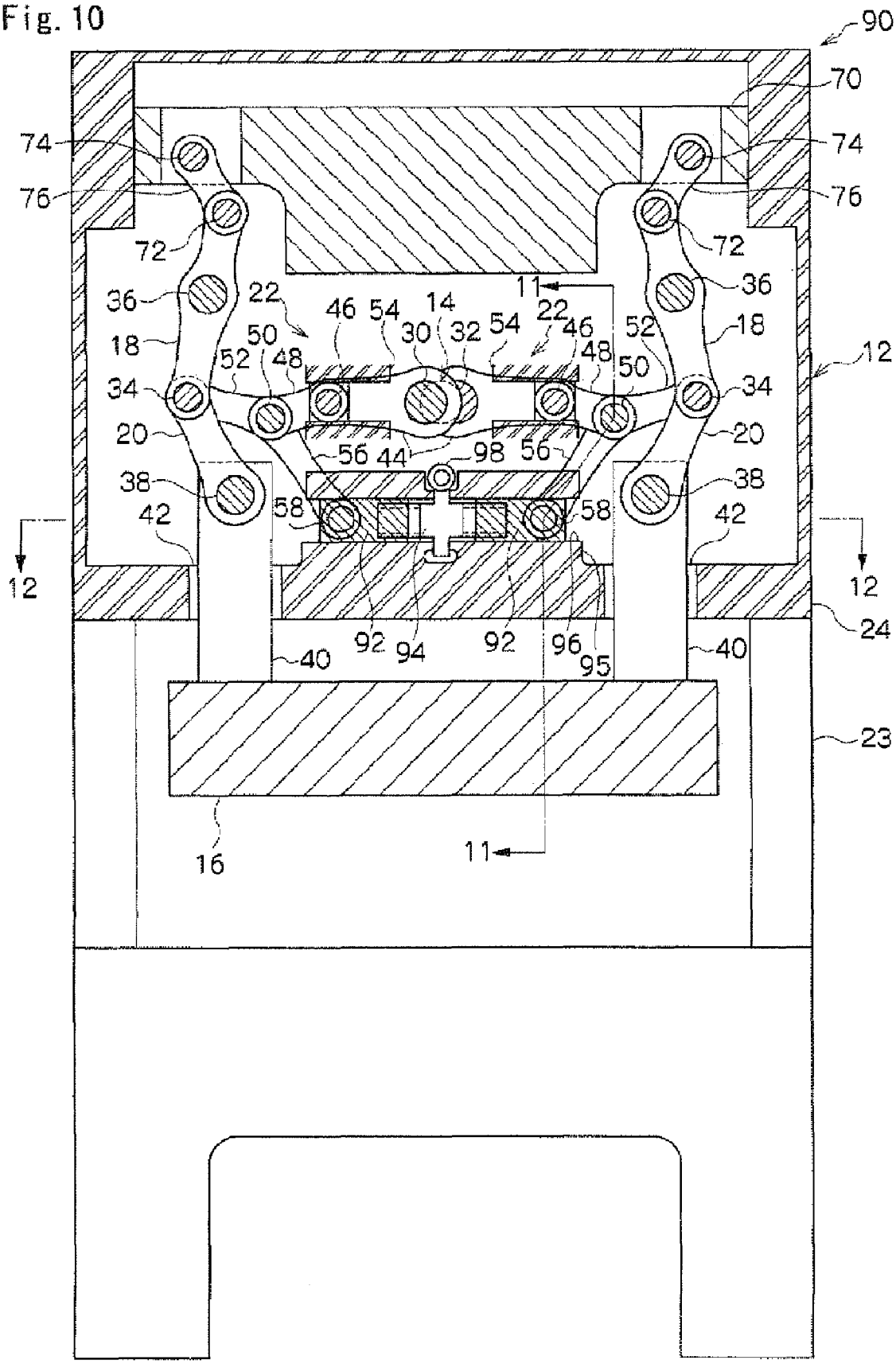
FIG. 10 is a vertical section of the press machine according to a fourth embodiment.
Figure 11:
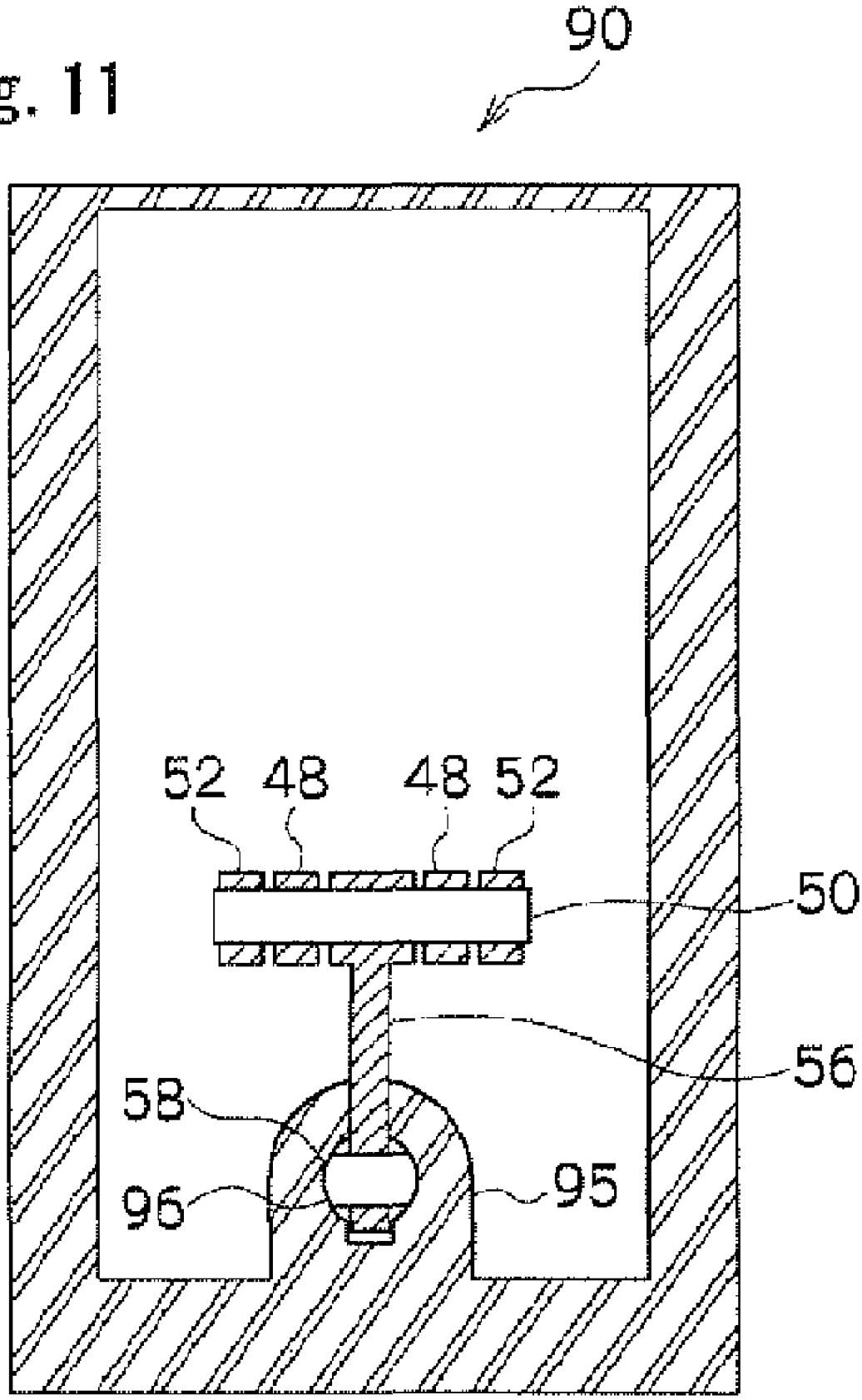
FIG. 11 is a cross section obtained along the line 11-11 in FIG. 10.
Figure 12:
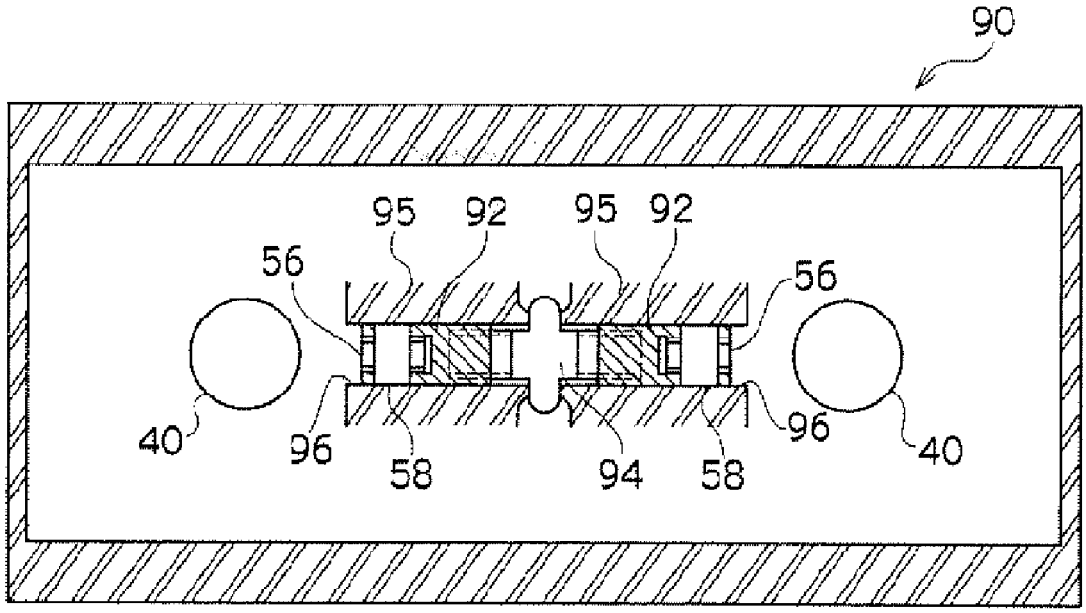
FIG. 12 is a cross section obtained along the line 12-12 in FIG. 10.

FIG. 10 is a vertical section of a press machine 90 according to the fourth embodiment. FIG. 11 is a cross section obtained along the line 11-11 in FIG. 10, and FIG. 12 is a vertical section obtained along the line 12-12 in FIG. 10.

Regarding the composing elements of press machine 90, the same reference numerals are given to the same composing elements, and explanation thereon is omitted.

As shown in FIG. 10, the press machine 90 comprises, as different composing elements from the press machine 10 in FIG. 1, two slide members 92 swingably connected to each pin 58, and one adjusting screw 94 attached thereto. Slide members 92 are inserted slidably into a through hole 96 of a bump portion 95 provided on the bottom plate of the upper frame 24. This bump portion 95 is provided integrally with the upper frame 24, but can be provided in another member separately from upper frame 24.

Adjusting screw 94 includes a worm screw 98, and by rotating worm screw 98, slide members 92 are moved by an equal distance within through hole 96 in opposite directions to each other. This movement of slide members 92 displaces pins 34, through the pins 50, and adjusts the stroke length of slide 16, the mechanism of which is the same as that of the first embodiment.

In this embodiment, like the third embodiment, the stroke length can be adjusted by displacing first pins 34 simultaneously and by the same amount by operation of the single adjusting screw 94, so that the top and bottom dead centers can be easily changed with slide 16 maintained in the horizontal state. Thus, in comparison with the first embodiment in which the amounts of movement of the two adjusting screws should be adjusted to be uniform, the stroke length can be accurately changed by a simple operation.

Embodiment 5

Figure 13:
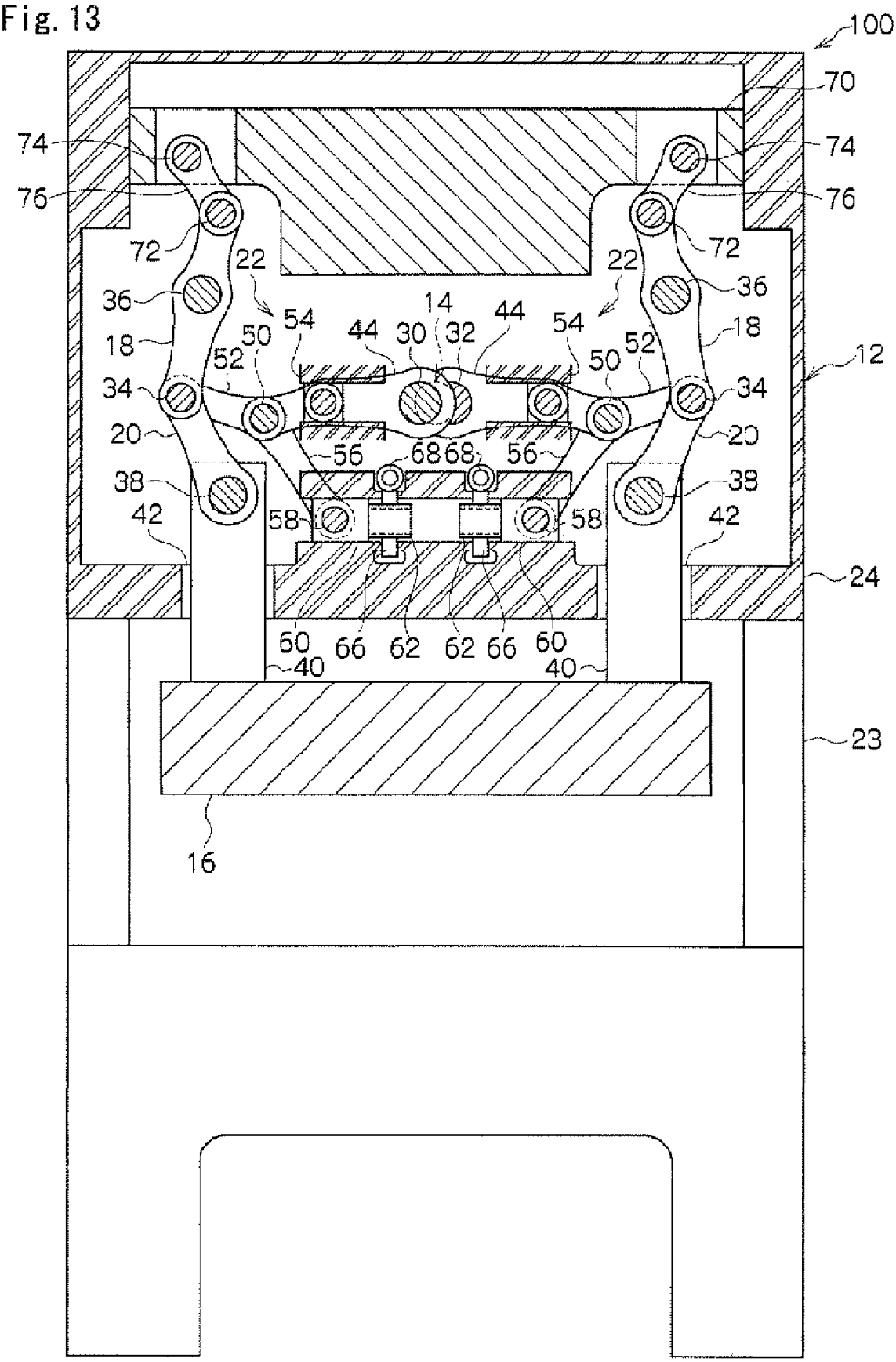
FIG. 13 is a vertical section of the press machine according a fifth embodiment.

FIG. 13 is a vertical section of a press machine 100 of a fifth embodiment. Regarding the structure of press machine 10), the same reference numerals are given to the same elements as those of press machine 10 in FIG. 1, and the explanations therefor are omitted.

As shown, as different elements from those of press machine 10, press machine 100 has two adjusting screws 60 inserted slidably within through hole 96 of bump portion 95 on the bottom plate of upper frame 24 which is extended between two plungers 40. While this bump portion 95 is provided integrally relative to upper frame 24, it may be provided in a separate member relative to upper frame 24.

By making adjusting screws 60 slide, pins 34 are displaced through pins 50, thereby adjusting the stroke length of slide 16, the mechanism of which is the same as that of the first embodiment.

In this embodiment, like the first embodiment, the stroke length of the slide 16 can not only be adjusted by each adjusting screw 60 but also the slide can be inclined according to each amount of adjustment of screws 60.

Embodiment 6

Figure 14:
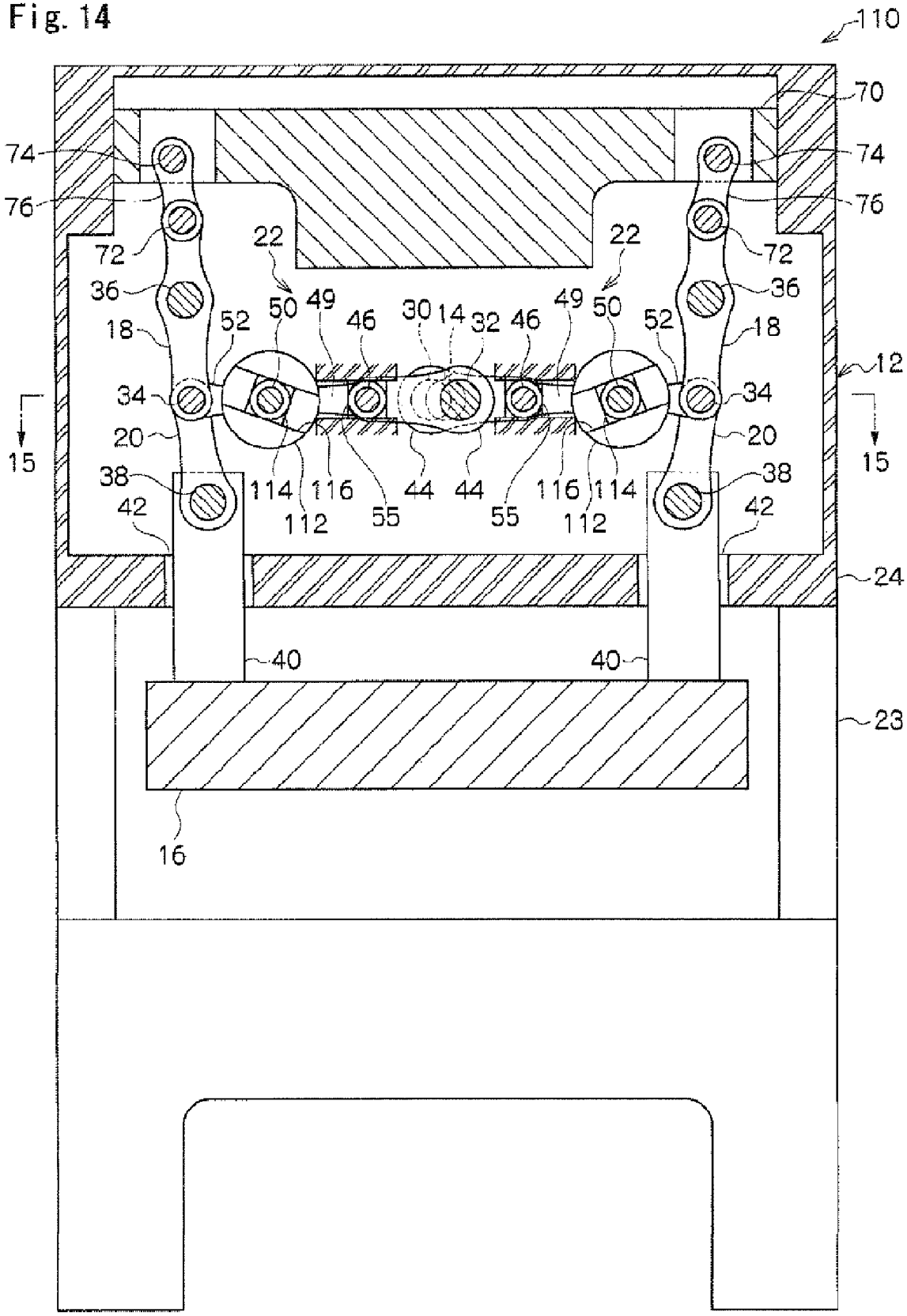
FIG. 14 is a vertical section of the press machine according to a sixth embodiment.

FIG. 14 is a vertical section of a press machine 110 according to a sixth embodiment. Regarding the composing elements of the press machine 110, the same reference numeral is given to the same elements as those of the press machine 10 in FIG. 1, and explanations thereof are omitted.

As shown in FIG. 14, press machine 110, as different elements from press machine 10 in FIG. 1, includes: a third lever 49 (FIG. 15) shaped like a one-side open rectangular section to be used in place of two third levers 48 of press machine 10; circular rotating members 112 to be used in place of fifth levers 56 and adjusting screws 60.

Figure 15:
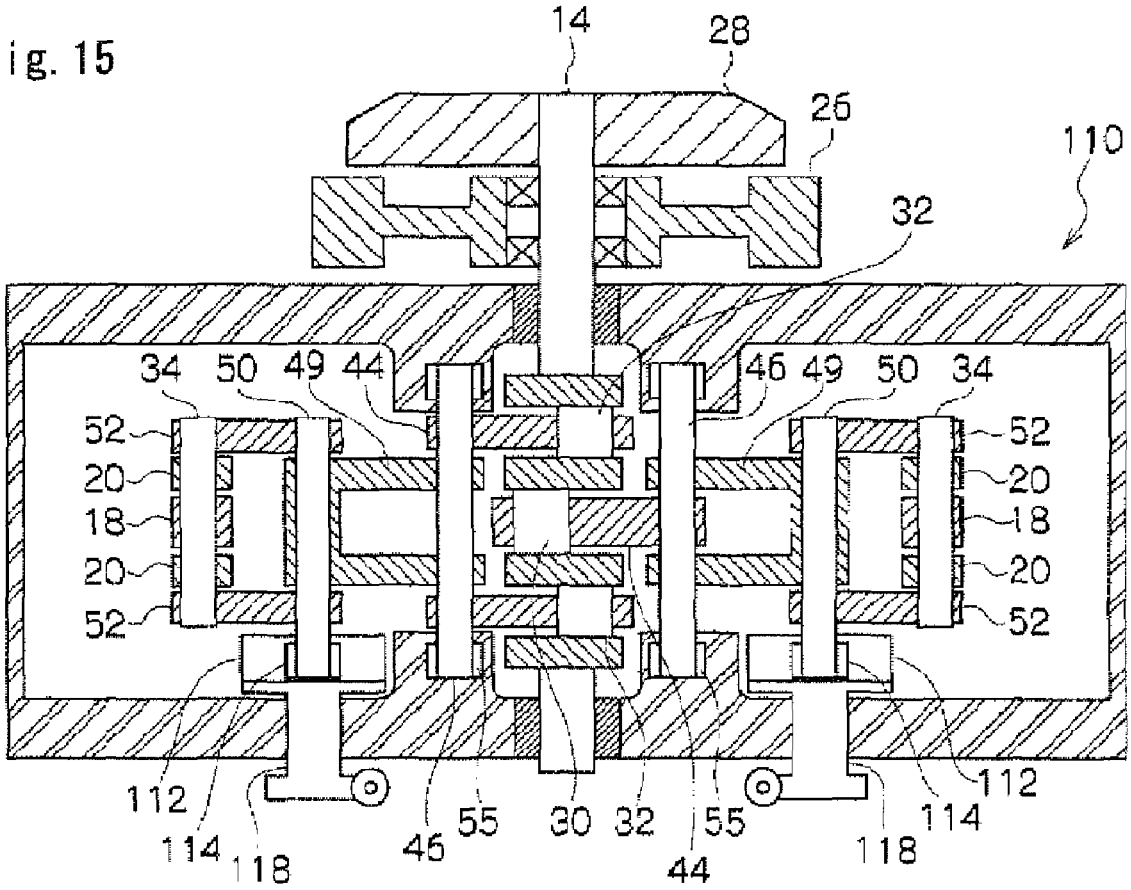
FIG. 15 is a vertical section obtained along the line 15-15 in FIG. 14.

Third levers 49 are swingably connected to fourth levers 52 through pins 50. Pins 50 have second slide members 114 to be fitted on its one end portion, and each rotating member 112 has a guide groove 116 slidably supporting slide member 114 in a radial direction of rotating member 112, and a worm screw 118 penetrating upper frame 24 as shown in FIG. 15. The rotation of worm screws 118 make the rotating members 112 rotate, thereby changing a guide angle of guide grooves 116 in which slide members 114 of pins 50 slide.

Figure 16:
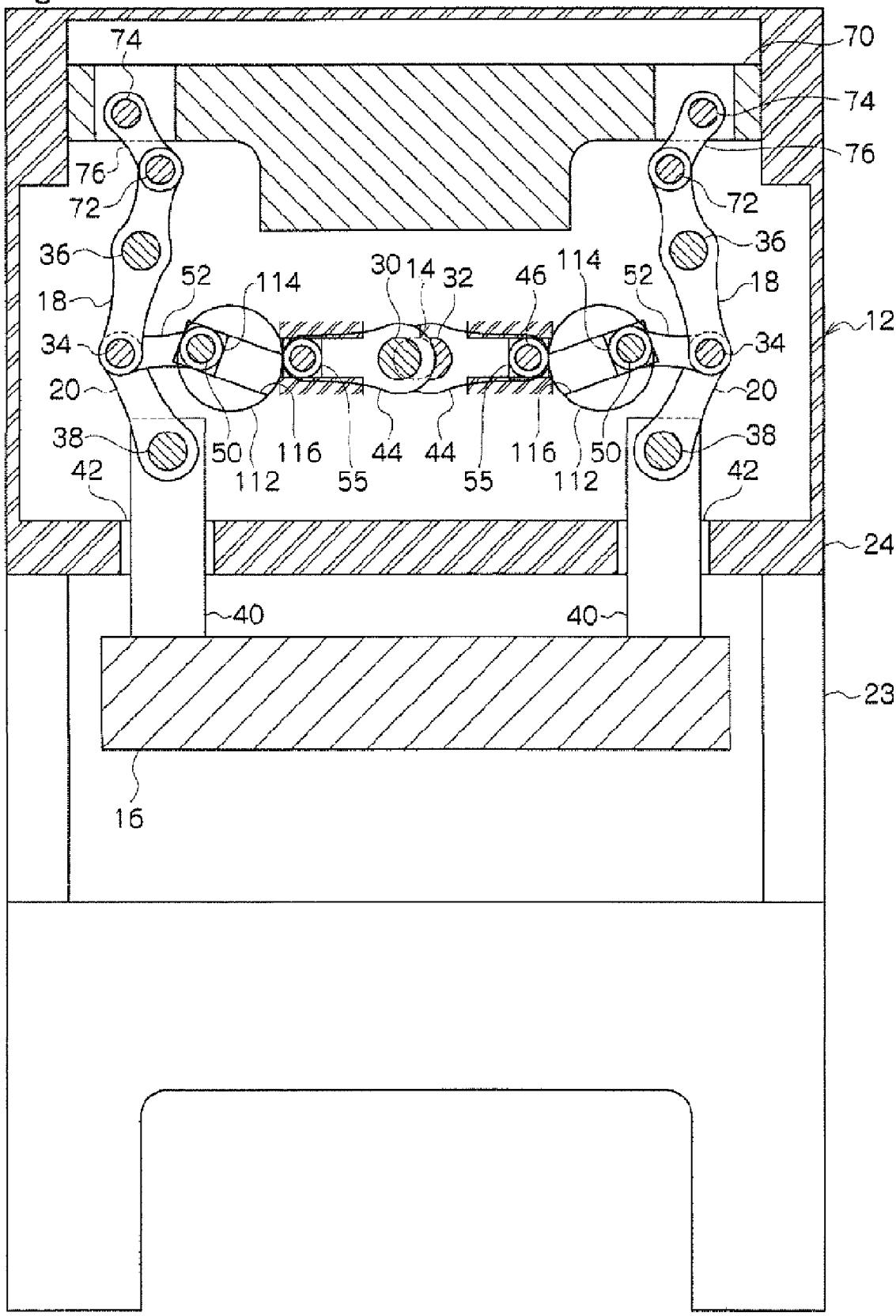
FIG. 16 is a vertical section of the press machine under operating condition of the linear approximation mechanism in FIG. 14.
Figure 18:
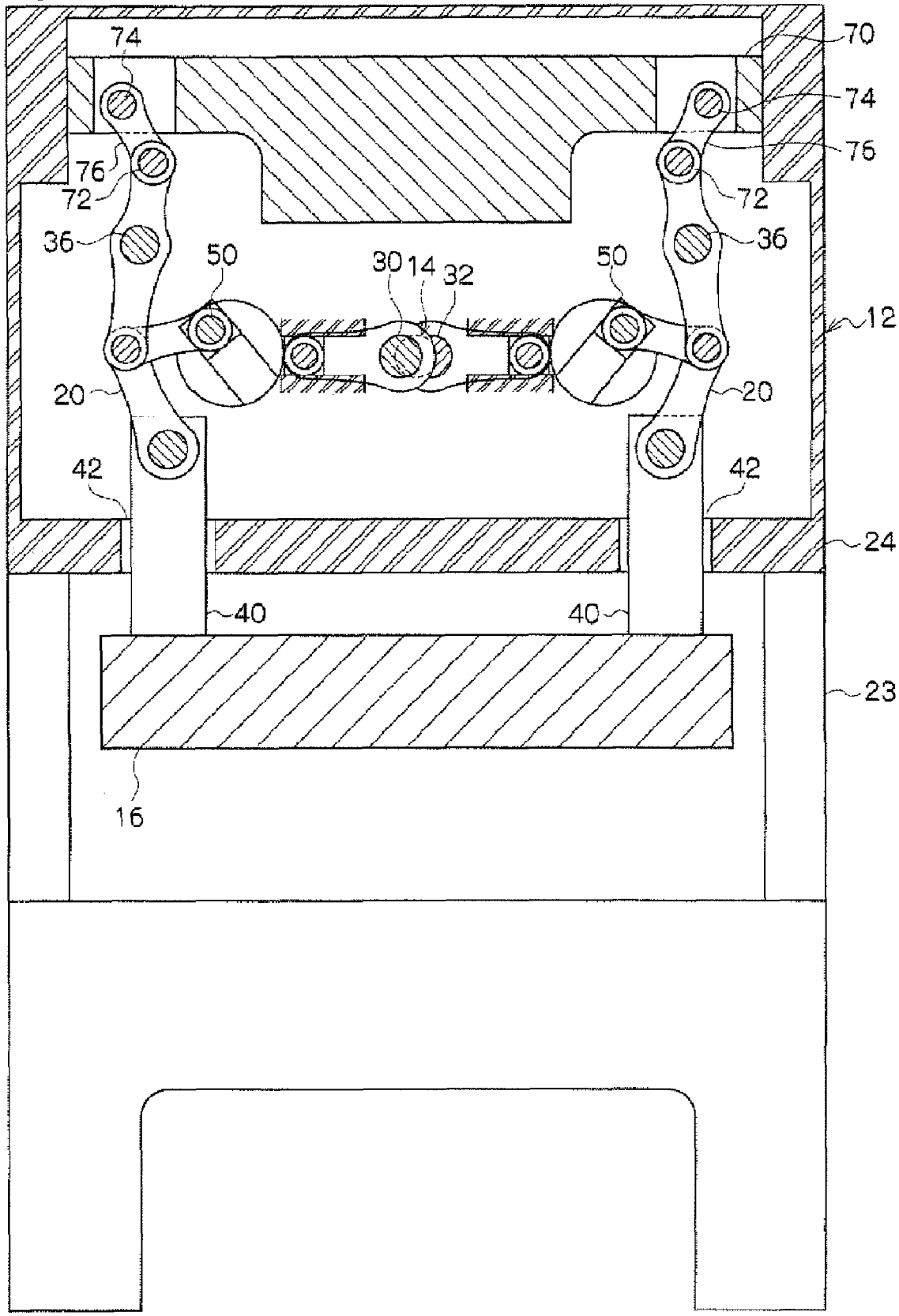
FIG. 18 is a vertical section of the press machine under operating condition of the linear approximation mechanism with the rotating angle of the rotating member in FIG. 16 changed.

As shown in FIGS. 16 and 18, by changing the guide angle, movement of each pin 50 is regulated by guide groove 116 through slide member 114 when actuating press machine 110 to displace pin 50 along the guide groove 116. Since pin 50 moves to a different position according to the guide angle, each pin 34 is displaced differently according to the guide angle. Thus, the top and bottom dead centers of the slide 16 are changed, enabling to adjust the stroke length.

Figure 17:
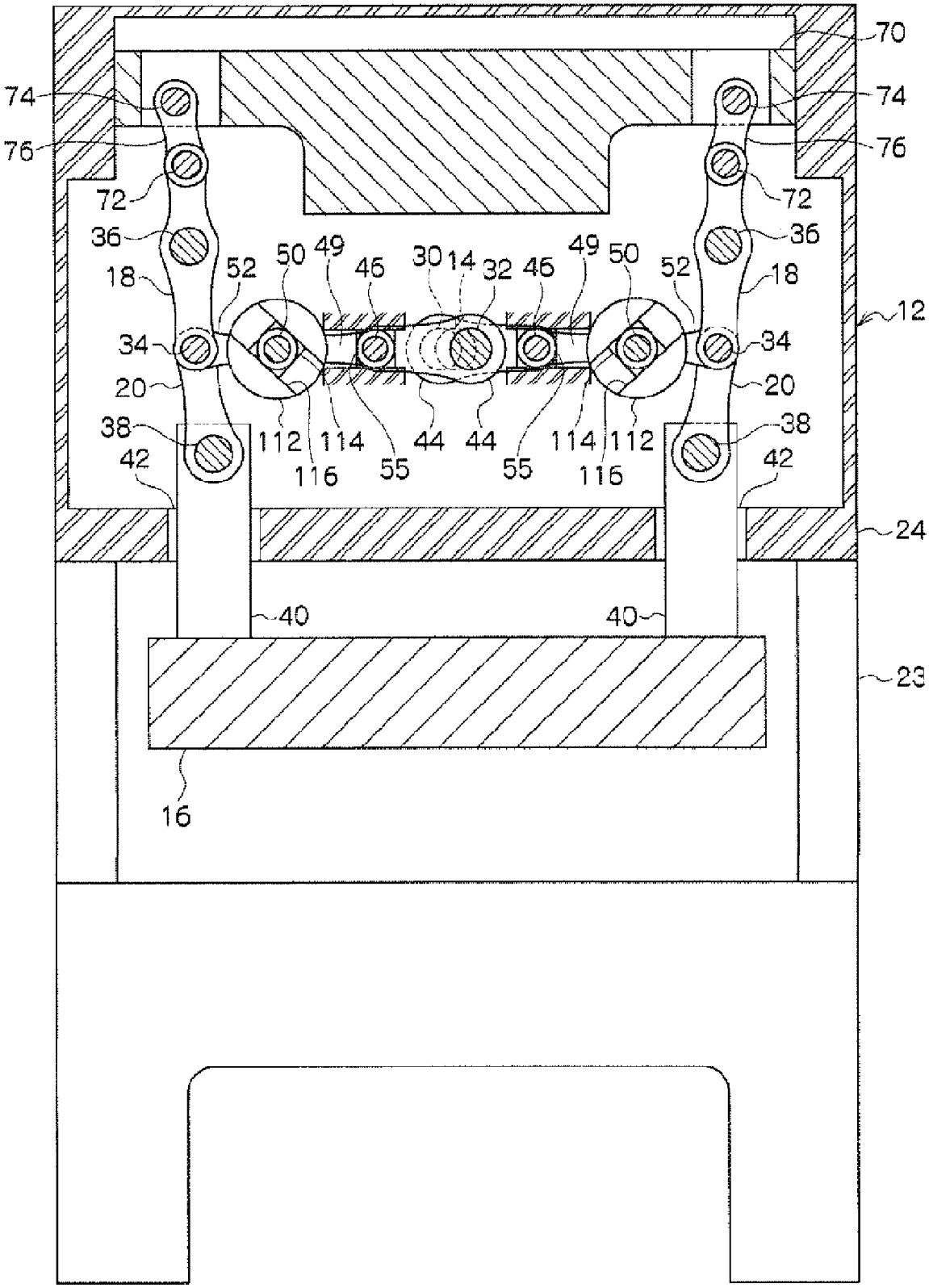
FIG. 17 is a vertical section of the press machine under operating condition of the linear approximation mechanism with the rotating angle of the rotating member in FIG. 14 changed.

Even if the guide angle of guide groove 116 is changed with pin 50 located at the center of the rotating member 112, as will be understood from FIGS. 14 and 17, the position of pin 50 does not change, and the bottom dead center of slide 16 does not change. On the other hand, as will be understood from FIGS. 16 and 18, by changing the guide angle with pin 50 not located at the center of rotating member 112, the position of pin 50 is changed by guide groove 116, changing the top dead center of slide 16. In the example shown, when the guide angle is changed from that in FIG. 10 to that in FIG. 18, the top dead center lowers.

In this embodiment, it is possible to provide an inclination to slide 16 like the first embodiment by adjusting the guide angles of the respective guide grooves 114 to be different from each other. Thus, an eccentric load can be corrected by providing the inclination to slide 116 with the eccentric load.

As mentioned above, in the first to fifth embodiments, in order to displace first pins 34, a force is applied to pins 34 through fourth levers 52 forming a part of linear approximation mechanisms 22 connected to first pins 34, but it is possible to displace pins 34 by connecting fifth levers 56 directly to pins 34. Likewise, according to the sixth embodiment, it is possible to displace pins 34 directly by attaching rotating members 112 to pins 34 and by adjusting the rotation angles of rotating members 112.

In the first to fifth embodiments, fourth levers 52 forming a part of linear approximation mechanisms 22 are used as a part of displacing mechanisms for displacing first pins 34, but it is possible to provide separate levers in place of fourth levers 52.

Further, in the first to fifth embodiments, third pins 50 of linear approximation mechanisms 22 are displaced, but when separate levers as mentioned above are provided, separate pins are provided in place of third pins 50, and the separate levers can be connected to fifth levers 56, 82 through the separate pins.

What is claimed is:

1. A press machine comprising:

a frame;

a crankshaft having a crankshaft axis and two eccentric portions rotatably borne on said frame;

an elevatable slide disposed under said crankshaft and characterized by an elevating stroke length;

two sets of levers provided directly on both sides of said crankshaft and supporting said slide, each set of the levers including a first lever swingably borne about an axis parallel to said crankshaft axis, and a second lever connected to said first lever through a first pin parallel to said crankshaft;

a displacing mechanism operatively connected to said frame for displacing said first pins and thereby providing an adjustment to the elevating stroke length of the slide;

a linear approximation mechanism for exerting a horizontal force to each of said first pins so as to convert a rotation of each of the eccentric portions of said crankshaft into an elevating stroke motion of said slide, wherein said linear approximation mechanism includes said first lever;

connections swingably connected to each of the eccentric portions of said crankshaft, wherein said frame is provided with a first groove extending horizontally relative to said crankshaft and slidably supporting said second pin;

third levers connected to said connections through second pins parallel to said crankshaft;

fourth levers connected to said third levers through third pins parallel to said crankshaft, wherein each of said first pins penetrates one of said fourth levers.

2. The press machine claimed in claim 1, wherein said displacing mechanism includes:

said fourth levers;

fifth levers connected to said third pins; and an adjusting screw connected to at least one of said fifth levers through a fourth pin, wherein said adjusting screw is attached to said frame so as to advance or retreat freely relative to said frame.

3. The press machine claimed in claim 2, wherein said linear approximation mechanism shares with said displacing mechanism said fourth pins and said adjusting screw.

4. The press machine claimed in claim 1, wherein said displacing mechanism includes:

said fourth levers;

fifth levers connected to said third pins; and an adjusting screw connected to at least one of said fifth levers through a fourth pin, in which said adjusting screw is attached to said frame movably along said frame.

5. The press machine claimed in claim 4, wherein said linear approximation mechanism shares with said displacing mechanism said adjusting screw.

6. The press machine claimed in claim 1, wherein said displacing mechanism includes:

said fourth levers;

rotating members rotatably attached to said frame; and a mechanism to adjust the rotation angle of said rotating members, wherein said rotating members are provided with a second groove slidably supporting said third pins.

7. A press machine comprising:

a frame;

a crankshaft having a crankshaft axis and two eccentric portions rotatably borne on said frame;

an elevatable slide disposed under said crankshaft;

two sets of levers provided on both sides of said crankshaft and supporting said slide, each set of the levers including a first lever swingably borne about an axis parallel to said crankshaft axis, and a second lever connected to said first lever through a first pin parallel to said crankshaft;

a displacing mechanism attached to said frame and for displacing said first pin;

a linear approximation mechanism for exerting a horizontal force to each first pin so as to convert a rotation of each of the eccentric portions of said crankshaft into an elevating motion of said slide;

wherein said linear approximation mechanism includes said first lever;

a connection swingably connected to each of the eccentric portions of said crankshaft;

a third lever connected to said connection through a second pin parallel to said crankshaft;

a fourth lever connected to said third lever through a third pin parallel to said crankshaft, and said first pin penetrating said fourth lever, and wherein said frame is provided with a first groove extending horizontally relative to said crankshaft and slidably supporting said second pin.

8. The press machine claimed in claim 7, wherein said displacing means includes:

said fourth lever;

a fifth lever connected to said third pin; and an adjusting screw connected to said fifth lever through a fourth pin; and wherein said adjusting screw is attached to said frame so as to advance or retreat freely relative to said frame.

9. The press machine claimed in claim 7, wherein said linear approximation mechanisms respectively share said fourth pin and said adjusting screw.

10. The press machine claimed in claim 7, wherein said displacing means includes:

said fourth lever;

a fifth lever connected to said third pin; and an adjusting screw connected to said fifth lever through a fourth pin; and wherein said adjusting screw is attached to said frame movably along said frame.

11. The press machine claimed in claim 7, wherein said linear approximation mechanisms respectively share said adjusting screw.

12. The press machine claimed in claim 7, wherein said displacing mechanism is provided with:

said fourth lever;

a rotating member rotatably attached to said frame; and a means for adjusting the rotation angle of said rotating member; and wherein said rotating member is provided with a second groove slidably supporting said third pin.

* * * * *